US006865255B2

(12) United States Patent
Richardson

(10) Patent No.: US 6,865,255 B2
(45) Date of Patent: Mar. 8, 2005

(54) EUV, XUV, AND X-RAY WAVELENGTH SOURCES CREATED FROM LASER PLASMA PRODUCED FROM LIQUID METAL SOLUTIONS, AND NANO-SIZE PARTICLES IN SOLUTIONS

(75) Inventor: Martin Richardson, Geneva, FL (US)

(73) Assignee: University of Central Florida, Orlando, FL (US)

( * ) Notice: Subject to any disclaimer, the term of this patent is extended or adjusted under 35 U.S.C. 154(b) by 33 days.

(21) Appl. No.: 10/082,658

(22) Filed: Oct. 19, 2001

(65) Prior Publication Data

US 2002/0141536 A1 Oct. 3, 2002

Related U.S. Application Data

(63) Continuation-in-part of application No. 09/881,620, filed on Jun. 14, 2001.
(60) Provisional application No. 60/242,102, filed on Oct. 20, 2000.

(51) Int. Cl.[7] ..... G21G 4/00
(52) U.S. Cl. ..... 378/119; 378/124; 378/143
(58) Field of Search ..... 378/34, 119, 124, 378/143

(56) References Cited

U.S. PATENT DOCUMENTS 4,024,400 A 5/1977 Blytas et al. ..... 250/432
4,182,574 A 1/1980 Quillfeldt ..... 356/318

(List continued on next page.)

FOREIGN PATENT DOCUMENTS

JP 57/41167 3/1982
JP 0267895 11/1990

OTHER PUBLICATIONS

Hertz, H. M., et al., Debris–free Soft X–ray Generation Using a Liquid Droplet Laser–Plasma Target, Department of Physics, Lund Institute of Technology, Sweden, *SPIE* vol. 2523, pp 88–93.
Rymell, L., et al., Droplet Target for Low–Debris Laser–Plasma Soft X–ray Generation, No. ½, pp. 105–110, *Optics Communications*, Nov. 1993.
T.P. Donaldson, *Soft X–ray Spectroscopy of Laser–Produced Plasmas with a Convex Mica Crystal Spectrometer*, X–ray Astronomy Group, vol. 9, p. 1645–1655, Mar. 1, 1976.
T. Mochizuki, *Soft X–ray Optics and Technology*, Proceedings Of SPIE–The International Society For Optical Engineering, vol. 733, p. 23–27, Dec. 1986.

(List continued on next page.)

*Primary Examiner*—Edward J. Glick
*Assistant Examiner*—Courtney Thomas
(74) *Attorney, Agent, or Firm*—Brian S. Steinberger; Law Offices of Brian S. Steinberger, P.A.

(57) ABSTRACT

Special liquid droplet targets that are irradiated by a high power laser and are plasmarized to form a point source EUV, XUV and x-ray source. Various types of liquid droplet targets include metallic solutions, and nano-sized particles in solutions having a melting temperature lower than the melting temperature of some or all of the constituent metals, used a laser point source target droplets. The solutions have no damaging debris and can produce plasma emissions in the X-rays, XUV, and EUV(extreme ultra violet) spectral ranges of approximately 0.1 nm to approximately 100 nm, approximately 11.7 nm and 13 nm, approximately 0.5 nm to approximately 1.5 nm, and approximately 2.3 nm to approximately 4.5 nm. The second type of target consists of various types of liquids which contain as a miscible fluid various nano-size particles of different types of metals and non-metal materials.

28 Claims, 6 Drawing Sheets

Examples:
$H_2O$
$MCl:H_2O$ [M=Al - Bi] (eg: $SnCl:H_2O$, $CsCl:H_2O$ etc)
organo-metallic liquids.

U.S. PATENT DOCUMENTS

| | | | | | |
|---|---|---|---|---|---|
| 4,328,464 | A | | 5/1982 | Pivirotto | 330/4.3 |
| 4,700,371 | A | | 10/1987 | Forsyth et al. | 378/34 |
| 4,723,262 | A | | 2/1988 | Noda et al. | 378/119 |
| 4,866,517 | A | | 9/1989 | Mochizuke et al. | 378/119 |
| 4,953,191 | A | | 8/1990 | Smither et al. | 378/143 |
| 5,052,034 | A | | 9/1991 | Schuster | 378/121 |
| 5,126,755 | A | | 6/1992 | Sharpe et al. | 346/75 |
| 5,142,297 | A | | 8/1992 | Eijkman et al. | 346/1.1 |
| 5,148,462 | A | | 9/1992 | Spitsyn et al. | 378/143 |
| 5,151,928 | A | | 9/1992 | Hirose | 378/119 |
| 5,243,638 | A | | 9/1993 | Wang et al. | 378/119 |
| 5,257,303 | A | | 10/1993 | Das Gupta | 378/85 |
| 5,317,574 | A | | 5/1994 | Wang | 372/5 |
| 5,459,771 | A | * | 10/1995 | Richardson et al. | 378/119 |
| 5,577,091 | A | * | 11/1996 | Richardson et al. | 378/119 |
| 5,577,092 | A | | 11/1996 | Kublak et al. | 378/119 |
| 5,991,360 | A | | 11/1999 | Matsui et al. | 378/119 |
| 6,002,744 | A | | 12/1999 | Hertz et al. | 378/119 |
| 6,069,937 | A | | 5/2000 | Oshino et al. | 378/119 |
| 6,180,952 | B1 | | 1/2001 | Haas et al. | 250/492.2 |
| 6,185,277 | B1 | | 2/2001 | Harding | 378/143 |
| 6,244,717 | B1 | | 6/2001 | Dinger | 359/859 |
| 6,285,743 | B1 | | 9/2001 | Kandaka | 378/119 |
| 6,304,630 | B1 | | 10/2001 | Bisschops et al. | 378/119 |
| 6,307,913 | B1 | * | 10/2001 | Foster et al. | 378/34 |
| 6,493,423 | B1 | | 12/2002 | Bisschops | 378/119 |
| 2003/0108155 | A1 | | 6/2001 | Elkins | 378/119 |
| 2002/0015473 | A1 | | 2/2002 | Hertz | 378/143 |
| 2002/0044629 | A1 | | 2/2002 | Hertz | 378/119 |
| 2002/0090054 | A1 | | 7/2002 | Sogard | 378/119 |

OTHER PUBLICATIONS

Martin Richardson, *Laser Plasma Source for X–ray Projection Lithography*, Laser–Induced Damage In Optical Materials, vol. 1848, p. 483–500, 1992.

W.T. Silfvast, *Laser–Produced Plasmas for X–ray Projection Lithography*, American Vacuum Society, p. 3126–3133, Aug. 4, 1992.

F. Jin, *Mass Limited Plasma Cyrogenic Target for 13NM Point X–ray Sources for Lithography*, Appication of Laser Plasma Radiation, vol. 2015, p. 1–9, Aug. 1993.

* cited by examiner

Examples:
$H_2O$
$MCl:H_2O$ [M=Al - Bi] (eg: $SnCl:H_2O$, $CuCl:H_2O$ etc)
organo-metallic liquids.

EUV, XUV, AND X-RAY WAVELENGTH SOURCES CREATED FROM LASER PLASMA PRODUCED FROM LIQUID METAL SOLUTIONS, AND NANO-SIZE PARTICLES IN SOLUTIONS

This invention relates to laser point sources, and in particular to methods and apparatus for producing EUV, XUV and X-Ray emissions from laser plasma produced from liquid metal solutions, and nano-particles in solution forms at room temperature, and this invention is a continuation-in-part of U.S. application Ser. No. 09/881,620 filed Jun. 14, 2001, and further claims the benefit of U.S. Provisional application No. 60/242,102 filed Oct. 20, 2000.

BACKGROUND AND PRIOR ART

The next generation lithographies (NGL) for advanced computer chip manufacturing have required the development of technologies such as extreme ultraviolet lithography (EUVL) as a potential solution. This lithographic approach generally relies on the use of multiplayer-coated reflective optics that has narrow pass bands in a spectral region where conventional transmissive optics is inoperable. Laser plasmas and electric discharge type plasmas are now considered prime candidate sources for the development of EUV. The requirements of this source, in output performance, stability and operational life are considered extremely stringent. At the present time, the wavelengths of choice are approximately 13 nm and 11.7 nm. This type of source must comprise a compact high repetition rate laser and a renewable target system that is capable of operating for prolonged periods of time. For example, a production line facility would require uninterrupted system operations of up to three months or more. That would require an uninterrupted operation for some 10 to the $11^{th}$ shots, and would require the unit shot material costs to be in the vicinity of 10 to minus 6 so that a full size stepper can run at approximately 40 to approximately 80 wafer levels per hour. These operating parameters stretch the limitations of conventional laser plasma facilities.

Generally, laser plasmas are created by high power pulsed lasers, focused to micron dimensions onto various types of solids or quasi-solid targets, that all have inherent problems. For example, U.S. Pat. No. 5,151,928 to Hirose described the use of film type solid target tapes as a target source. However, these tape driven targets are difficult to construct, prone to breakage, costly and cumbersome to use and are known to produce low velocity debris that can damage optical components such as the mirrors that normally used in laser systems.

Other known solid target sources have included rotating wheels of solid materials such as Sn or tin or copper or gold, etc. However, similar and worse than to the tape targets, these solid materials have also been known to produce various ballistic particles sized debris that can emanate from the plasma in many directions that can seriously damage the laser system's optical components. Additionally these sources have a low conversion efficiency of laser light to in-band EUV light at only 1 to 3%.

Solid Zinc and Copper particles such as solid discs of compacted materials have also been reported for short wavelength optical emissions. See for example, T. P. Donaldson et al. Soft X-ray Spectroscopy of Laser-produced Plasmas, J. Physics, B:Atom. Molec. Phys., Vol. 9, No. 10. 1976, pages 1645–1655. FIGS. 1A and 1B show spectra emissions of solid Copper (Cu) and Zinc (Zn) targets respectively described in this reference. However, this reference requires the use of solid targets that have problems such as the generation of high velocity micro type projectiles that causes damage to surrounding optics and components. For example, page 1649, lines 33–34, of this reference states that a "sheet of mylar . . . was placed between the lens and target in order to prevent damage from ejected target material . . . ." Thus, similar to the problems of the previously identified solids, solid Copper and solid Zinc targets also produce destructive debris when being used. Shields such as mylar, or other thin film protectors may be used to shield against debris for sources in the X-ray range, though at the expense of rigidity and source efficiency. However, such shields cannot be used at all at longer wavelengths in the XUV and EUV regions.

Frozen gases such as Krypton, Xenon and Argon have also been tried as target sources with very little success. Besides the exorbitant cost required for containment, these gases are considered quite expensive and would have a continuous high repetition rate that would cost significantly greater than $10 to the minus 6. Additionally, the frozen gasses have been known to also produce destructive debris as well, and also have a low conversion efficiency factor.

An inventor of the subject invention previously developed water laser plasma point sources where frozen droplets of water became the target point sources. See U.S. Pat. Nos. 5,459,771 and 5,577,091 both to Richardson et al., which are both incorporated by reference. It was demonstrated in these patents that oxygen was a suitable emitter for line radiation at approximately 11.6 nm and approximately 13 nm. Here, the lateral size of the target was reduced down to the laser focus size, which minimized the amount of matter participating in the laser matter interaction process. The droplets are produced by a liquid droplet injector, which produces a stream of droplets that may freeze by evaporation in the vacuum chamber. Unused frozen droplets are collected by a cryogenic retrieval system, allowing reuse of the target material. However, this source displays a similar low conversion efficiency to other sources of less than approximately 1% so that the size and cost of the laser required for a full size 300 mm stepper running at approximately 40 to approximately 80 wafer levels per hour would be a considerable impediment.

Other proposed systems have included jet nozzles to form gas sprays having small sized particles contained therein, and jet liquids. See for Example, U.S. Pat. No. 6,002,744 to Hertz et al. and U.S. Pat. No. 5,991,360 to Matsui et al. However, these jets use more particles and are not well defined, and the use of jets creates other problems such as control and point source interaction efficiency. U.S. Pat. No. 5,577,092 to Kulak describes cluster target sources using rare expensive gases such as Xenon would be needed.

Attempts have been made to use a solid liquid target material as a series of discontinuous droplets. See U.S. Pat. No. 4,723,262 to Noda et al. However, this reference states that liquid target material is limited by example to single liquids such as "preferably mercury", abstract. Furthermore, Noda states that " . . . although mercury as been described as the preferred liquid metal target, any metal with a low melting point under 100 C. can be used as the liquid metal target provided an appropriate heating source is applied. Any one of the group of indium, gallium, cesium or potassium at an elevated temperature may be used . . . ", column 6, lines 12–19. Thus, this patent again is limited to single metal materials and requires an "appropriate heating source (be) applied . . . " for materials other than mercury.

The inventor is aware of other patents of interest. See for example, U.S. Pat. No. 4,866,517 to Mochizuki; U.S. Pat.

No. 5,052,034 to Schuster; U.S. Pat. No. 5,317,574 to Wang; U.S. Pat. No. 6,069,937 to Oshino; U.S. Pat. No. 6,180,952 to Haas; and U.S. Pat. No. 6,185,277 to Harding. The Mochizuki '517 is restricted to using a target gas, or liquid that is supplied to a cryogenic belt. Schuster '034 describes a liquid anode x-ray generator for electrical discharge source and not for a laser plasma source. Their use of a liquid electrodes allows for higher heat loads (greater heat dissipation) and renewability of electrode surface.

Wang '574 describes an x-ray or EUV laser scheme in which a long cylindrical electrical discharge plasma is created from a liquid cathode, where atoms from the cathode are ionized to form a column plasma. Oshino '937 describes a laser plasma illumination system for EUVL having multiple laser plasmas acting as EUV light sources and illuminating optics, and describes targets of low melting point which can be liquid or gas.

Haas '952 describes a nozzle system for a target for a EUV light source where the nozzle is used for various types of gasses. Harding '277 describes an electrical discharge x-ray source where one of the electrodes uses a liquid for higher heat removal, leading to higher source powers, and does not use metals for the spectral emissions it gives off as a plasma. Dinger '717 describes various EUV optical elements to be incorporated with an EUV source.

None of the prior art describes using droplets of metal fluids and nano particles as target plasmas that give off spectral emissions.

SUMMARY OF THE INVENTION

The primary objective of the subject invention is to provide an inexpensive and efficient target droplet system as a laser plasma source for radiation emissions such as those in the EUV, XUV and x-ray spectrum.

The secondary objective of the subject invention is to provide a target source for radiation emissions such as those in the EUV, XUV and x-ray spectrum that are both debris free and that eliminates damage from target source debris.

The third objective of the subject invention is to provide a target source having an in-band conversion efficiency rate exceeding those of solid targets, frozen gasses and particle gasses, for radiation emissions such as those in the EUV, XUV and x-ray spectrum.

The fourth objective of the subject invention is to provide a target source for radiation emissions such as those in the EUV, XUV and x-ray spectrum, that uses metal liquids that do not require heating sources.

The fifth objective of the subject invention is to provide a target source for radiation emissions such as those in the EUV, XUV and x-ray spectrum that uses metals having a liquid form at room temperature.

The sixth objective of the subject invention is to provide a target source for radiation emissions such as those in the EUV, XUV and x-ray spectrum that uses metal solutions of liquids and not single metal liquids.

The seventh objective of the subject invention is to provide a target source for emitting plasma emissions of approximately 0.1 nm to approximately 100 nm spectral range.

The eighth objective of the subject inventions is to provide a target source for emitting plasma emissions at approximately 11.7 nm.

The ninth objective of the subject invention is to provide a target source for emitting plasma emissions at approximately 13 nm.

The tenth objective of the subject invention is to provide a target source for emitting plasma emissions in the range of approximately 0.5 nm to approximately 1.5 nm.

The eleventh objective of the subject invention is to provide a target source for emitting plasma emissions in the range of approximately 2.3 nm to approximately 4.5 nm.

The twelfth objective of the subject invention is to provide a target source for radiation emissions such as those in the EUV, XUV and x-ray spectrum that uses nano-particle metals having a liquid form at room temperature.

The thirteenth objective of the subject invention is to provide a target source using nano sized droplets as plasma sources for generating X-rays, EUV and XUV emissions.

A first preferred embodiment of the invention uses metallic solutions as efficient droplet sources. The metal solutions have a metal component where the metallic solution is in a liquid form at room temperature ranges of approximately 10 degrees C. to approximately 30 degrees C. The metallic solutions include molecular liquids or mixtures of elemental and molecular liquids. Each of the microscopic droplets of liquids of various metals can have droplet diameters of approximately 10 micrometers to approximately 100 micrometers.

The molecular liquids or mixtures of elemental and molecular liquids can include metallic chloride solution including ZnCl(zinc chloride), CuCl(copper chloride), SnCl (tin chloride), AlCl(aluminum chloride), and BiCl(bismuth chloride) and other chloride solutions. Additionally, the metal solutions can be metallic bromide solutions such as CuBr, ZnBr, AIBr, or any other transition metal that can exist in a bromide solution at room temperature.

Other metal solutions can be made of the following materials in a liquid solvent. For example, Copper sulfate (CuSO4), Zinc sulfate(ZnSO4), Tin nitrate(SnSO4), or other transition metals that can exist as a sulfate can be used. Copper nitrate(CuNO3), Zinc nitrate(ZnNO3), Tin nitrate (SnNO3), or any other transition metal that can exist as a nitrate can be used.

Additionally, the metallic solutions can include organometallic solutions such as but not limited to Bromoform (CHBr3), Diodomethane(CH2I2), and the like. Furthermore, miscellaneous metal solutions can also be used such as but not limited to Selenium Dioxide(SeO2) at approximately 38 gm/100 cc, and Zinc Dibromide(ZnBr2) at approximately 447 gm per 100 cc.

A second preferred embodiment can use and nanoparticles in solutions in a liquid form at room temperature ranges of approximately 10 degrees C. to approximately 30 degrees C.

The metallic solutions can include mixtures of metallic nano-particles in liquids such as Tin(Sn), Copper(Cu), Zinc (Zn), Gold(Au), Al(aluminum) and/or Bi(bismuth)and liquids such as H20, oils, oleates, soapy solutions, alcohols, and the like.

The metallic solutions in the preferred embodiment can be useful as target sources from emitting lasers that can produce plasma emissions at across broad ranges of the X-ray, EUV, and XUV emission spectrums, depending on which ionic states are created in the plasma.

Further objects and advantages of this invention will be apparent from the following detailed description of a presently preferred embodiment, which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

First Embodiment

FIGS. 1–5*b* are described in parent application U.S. application Ser. No. 09/881,620 filed on Jun. 14, 2001 which is incorporated by reference.

Figure 1A:
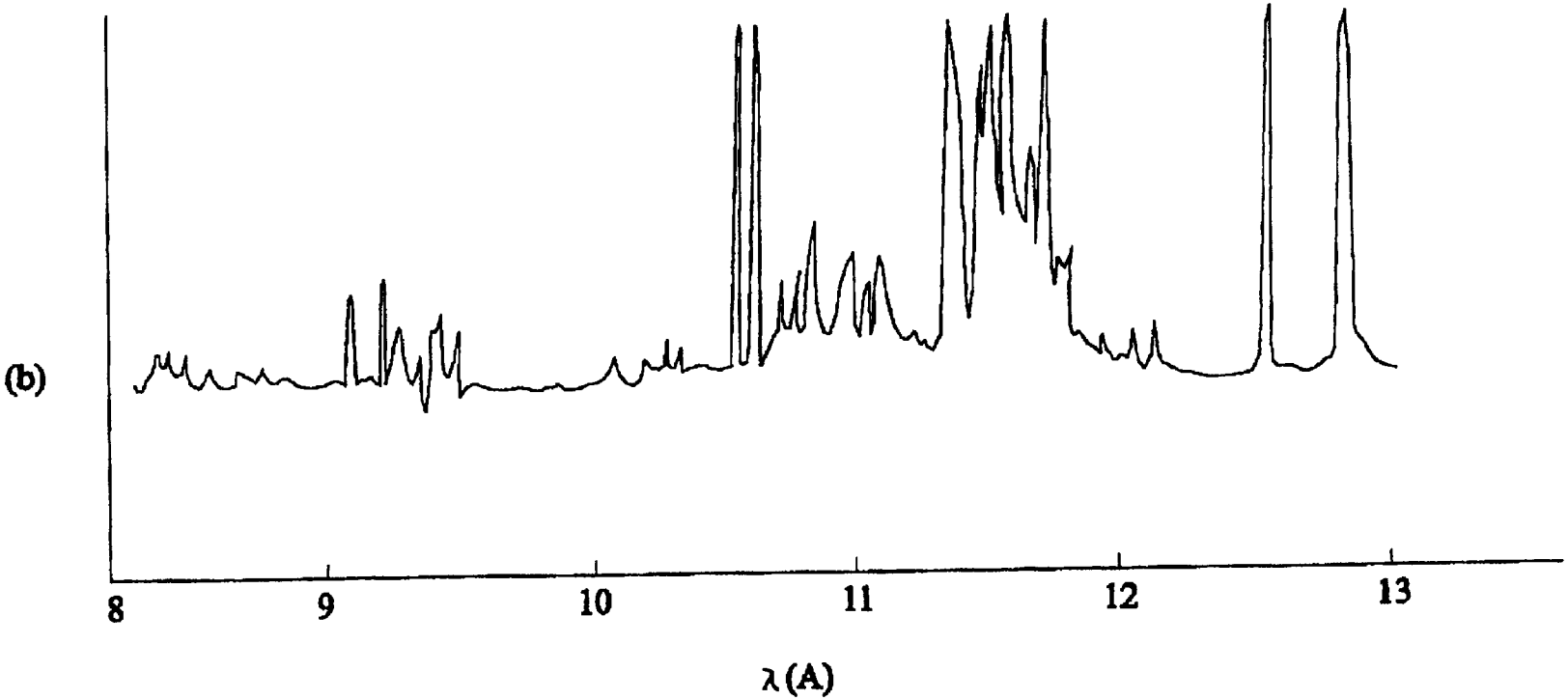
Fig. 1A (Prior Art)
FIG. 1*a* shows a prior art spectra of using a solid Copper(Cu) target being irradiated.
Figure 1B:
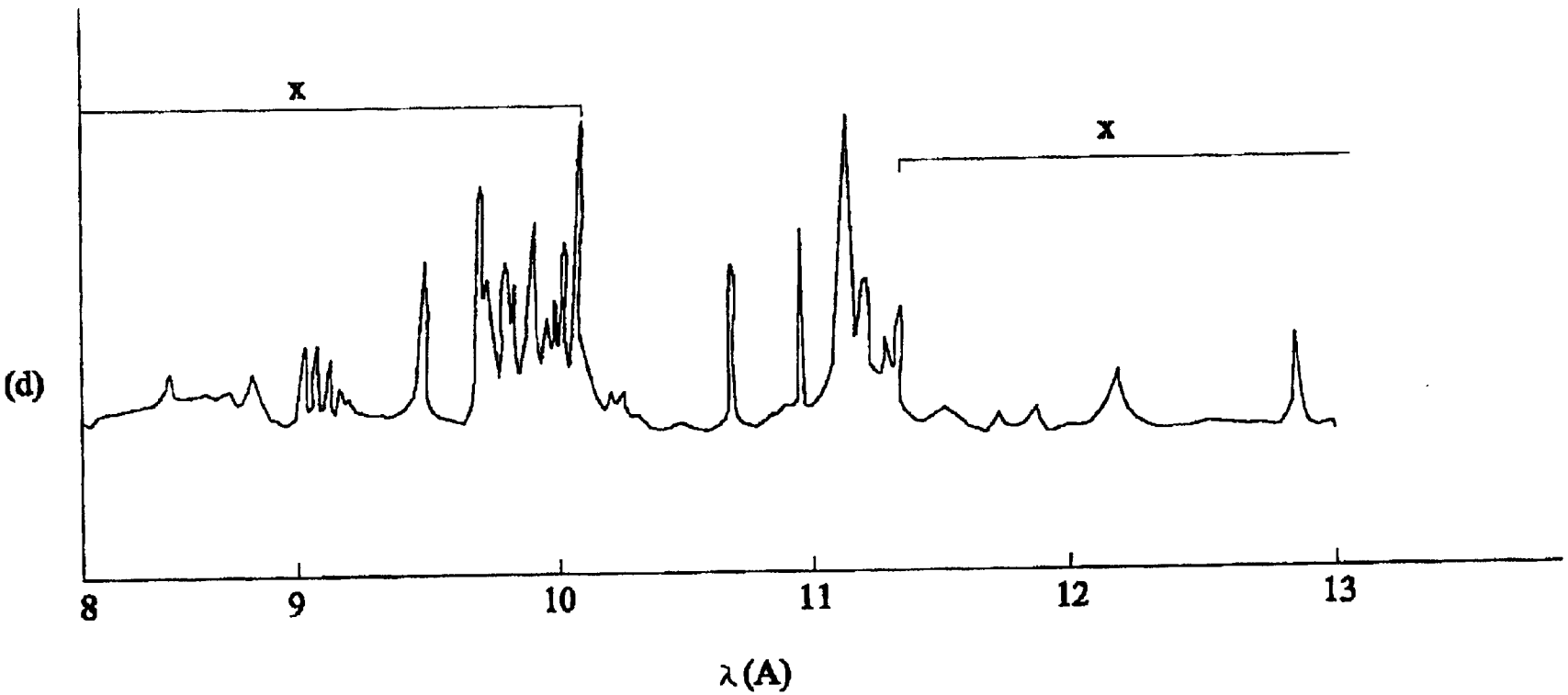
Fig. 1B (Prior Art)
FIG. 1*b* shows a prior art spectra of using Zinc(Zn) target being irradiated.
Figure 2:
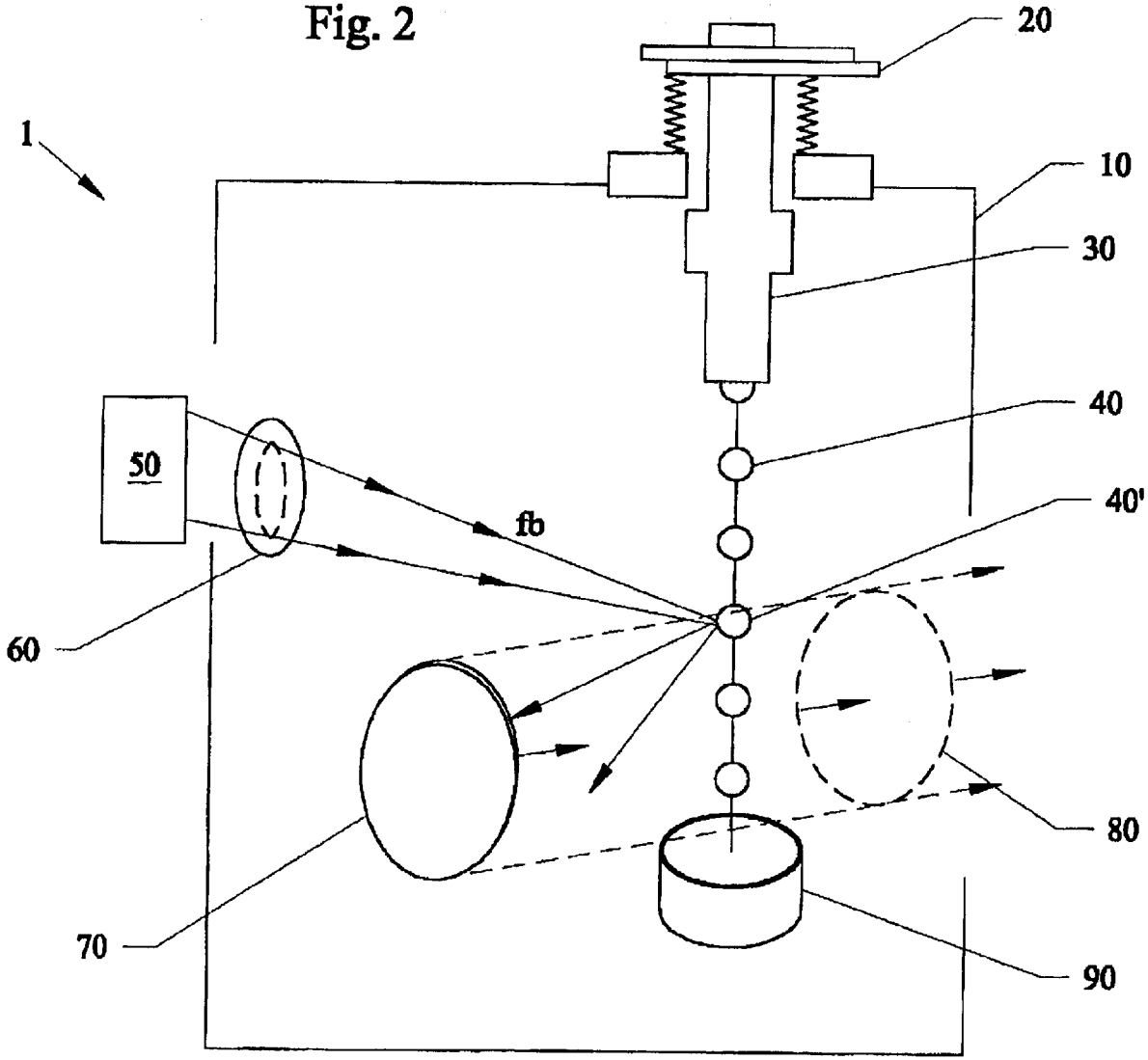
FIG. 2 shows a layout of an embodiment of the invention.

FIG. 2 shows a layout of an embodiment 1 of the invention. Vacuum chamber 10 can be made of aluminum, stainless steel, iron, or even solid-non-metallic material. The vacuum in chamber 10 can be any vacuum below which laser breakdown of the air does not occur (for example, less than approximately 1 Torr). The Precision Adjustment 20 of droplet can be a three axis position controller that can adjust the position of the droplet dispenser to high accuracy (micrometers) in three orthogonal dimensions. The droplet dispenser 30 can be a device similar to that described in U.S. Pat. Nos. 5,459,771 and 5,577,091 both to Richardson et al., and to the same assignee of the subject invention, both of which are incorporated by reference, that produces a continuous stream of droplets or single droplet on demand. Laser source 50 can be any pulsed laser whose focused intensity is high enough to vaporize the droplet and produce plasma from it. Lens 60 can be any focusing device that focuses the laser beam on to the droplet. Collector mirror 70 can be any EUV, XUV or x-ray optical component that collects the radiation from the point source plasma created from the plasma. For example it can be a normal incidence mirror (with or without multiplayer coating), a grazing incidence mirror, (with or without multiplayer coating), or some type of free-standing x-ray focusing device (zone plate, transmission grating, and the like). Label 90 refers to the EUV light which is collected. Cryogenic Trap 90 can be a device that will collect unused target material, and possibly return this material for re-use in the target dispenser. Since many liquid targets used in the system will be frozen by passage through the vacuum system, this trap will be cooled to collect this material in the vacuum, until such time as it is removed. Maintaining this material in a frozen state will prevent the material from evaporating into the vacuum chamber and thereby increasing the background pressure. An increase in the background pressure can be detrimental to the laser-target interaction, and can serve to absorb some or all of the radiation produced by the plasma source. A simple configuration of a cryogenic trap, say for water-based targets, would be a cryogenically cooled "bucket" or container, into which the un-used droplets are sprayed. The droplets will stick to the sides of this container, and themselves, until removed from the vacuum chamber.

It is important that the laser beam be synchronized such that it interacts with a droplet when the latter passes through the focal zone of the laser beam. The trajectory of the droplets can be adjusted to coincide with the laser axis by the precision adjustment system. The timing of the laser pulse can be adjusted by electrical synchronization between the electrical triggering pulse of the laser and the electrical pulse driving the droplet dispenser. Droplet-on-demand operation can be effected by deploying a separate photodiode detector system that detects the droplet when it enters the focal zone of the laser, and then sends a triggering signal to fire the laser.

Referring to FIG. 2, after the droplet system 1 has been adjusted so that droplets are in the focal zone of the laser 50, the laser is fired. In high repetition mode, with the laser firing at rates of approximately 1 to approximately 100 kHz, the droplets or some of the droplets are plasmarized at 40'. EUV, XUV and/or x-rays 80 emitted from the small plasma can be collected by the collecting mirror 70 and transmitted out of the system. In the case where no collecting device is used, the light is transmitted directly out of the system.

Figure 3A:
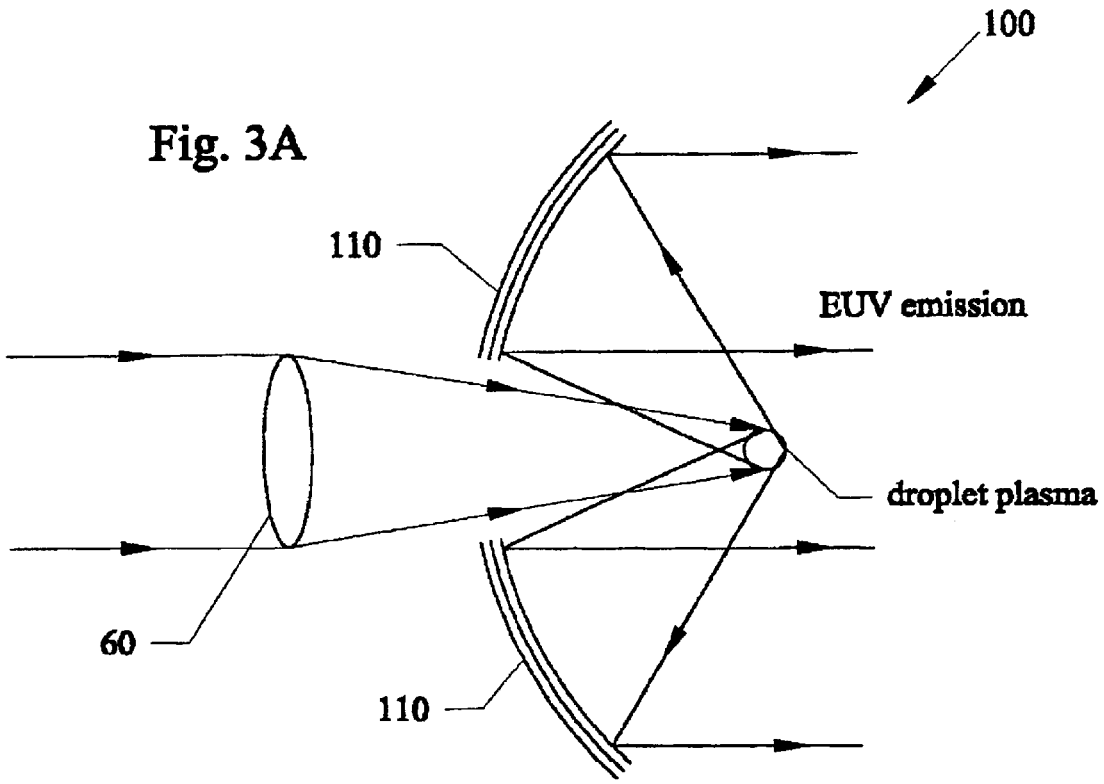
FIG. 3*a* shows a co-axial curved collecting mirror for use with the embodiment of FIG. 1.

FIG. 3*a* shows a co-axial curved collecting mirror 100 for use with FIG. 2. Mirror 110 can be a co-axial high Na EUV collecting mirror, such as a spherical, parabolic, ellipsoidal, hyperbolic reflecting mirror and the like. For example, like the reflector in a halogen lamp one mirror, axially symmetric or it could be asymmetric about the laser axis can be used. For EUV radiation it would be coated with a multi-layer coating (such as alternate layers of Molybdenum and Silicon) that act to constructively reflect light or particular wavelength (for example approximately 13 nm or approximately 11 nm or approximately 15 nm or approximately 17 nm, and the like). Radiation emanating from the laser-irradiated plasma source would be collected by this mirror and transmitted out of the system.

Figure 3B:
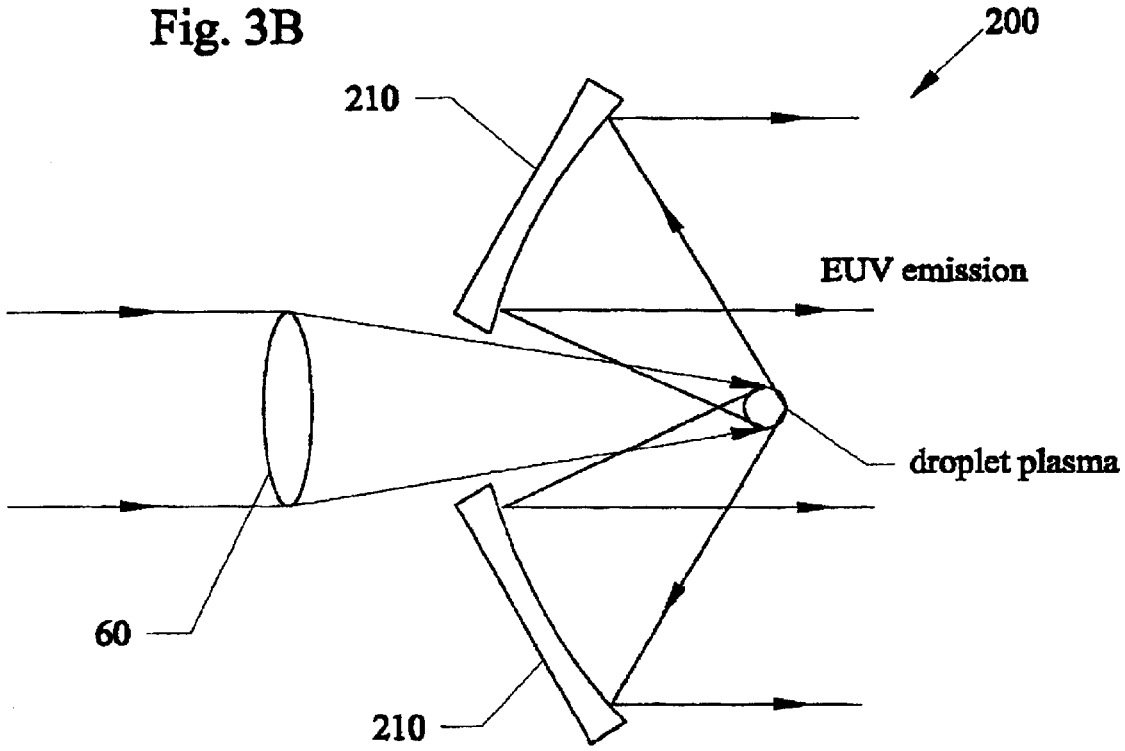
FIG. 3*b* shows multiple EUV mirrors for use with embodiment of FIG. 1.

FIG. 3*b* shows multiple EUV mirrors for use with embodiment of FIG. 2. Mirrors 210 can be separate high NA EUV collecting mirrors such as curved, multilayer-coated mirrors, spherical mirrors, parabolic mirrors, ellipsoidal mirrors, and the like. Although, two mirrors are shown, but there could be less or more mirrors such as an array of mirrors depending on the application.

Mirror 210 of FIG. 3*b*, can be for example, like the reflector in a halogen lamp one mirror, axially symmetric or it could be asymmetric about the laser axis can be used. For EUV radiation it would be coated with a multi-layer coating (such as alternate layers of Molybdenum and Silicon) that act to constructively reflect light or particular wavelength (for example approximately 13 nm or approximately 11 nm or approximately 15 nm or approximately 17 nm, and the like). Radiation emanating from the laser-irradiated plasma source would be collected by this mirror and transmitted out of the system.

Figure 4:
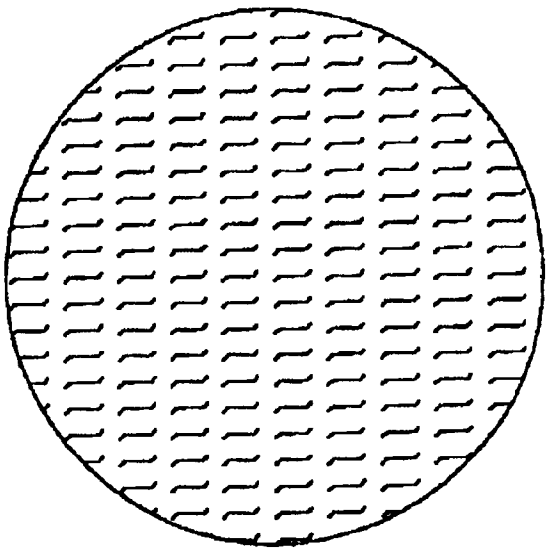
FIG. 4 is an enlarged droplet of a molecular liquid or mixture of elemental and molecular liquids that can be used in the preceding embodiment figures.

FIG. 4 is an enlarged droplet of a metallic solution droplet. The various types of metal liquid droplets will be further defined in reference to Tables 1A–1F, which lists various metallic solutions that include a metal component that is in a liquid form at room temperature.

TABLE 1A

| Metal chloride solutions |
|---|
| ZnCl(zinc chloride) |
| CuCl(copper chloride) |

TABLE 1A-continued

| Metal chloride solutions |
|---|
| SnCl(tin chloride)<br>AlCl(aluminum chloride)<br>Other transition metals that include chloride |

TABLE 1B

| Metal bromide solutions |
|---|
| CuBr (copper bromide)<br>ZnBr (zinc bromide)<br>SnBr (tin bromide)<br>Other transition metals that can exist as a Bromide |

TABLE 1C

| Metal Sulfate Solutions |
|---|
| CuS04 (copper sulfate)<br>ZnS04 (zinc sulfate)<br>SnS04 (tin sulfate)<br>Other transition metals that can exist as a sulfate. |

TABLE 1D

| Metal Nitrate Solutions |
|---|
| CuN03 (copper nitrate)<br>ZnN03 (zinc nitrate)<br>SnN03 (tin nitrate)<br>Other transition metals that can exist as a nitrate |

TABLE 1E

| Other metal solutions where the metal is in an organo-metallic solution. |
|---|
| CHBr3(Bromoform)<br>CH2I2(Diodomethane)<br>Other metal solutions that can exist as an organo-metallic solution |

TABLE 1F

| Miscellaneous Metal Solutions |
|---|
| SeO2(38 gm/100 cc) (Selenium Dioxide)<br>ZnBr2(447 gn/100 cc) (Zinc Dibromide) |

For all the solutions in Tables 1A–1F, the metal solutions can be in a solution form at a room temperature of approximately 10 degrees C. to approximately 30 degrees. Each of the droplet's diameters can be in the range of approximately 10 to approximately 100 microns, with the individual metal component diameter being in a diameter of that approaching approximately one atom diameter as in a chemical compound. The targets would emit wavelengths in the EUV, XUV and X-ray regions.

Figure 5B:
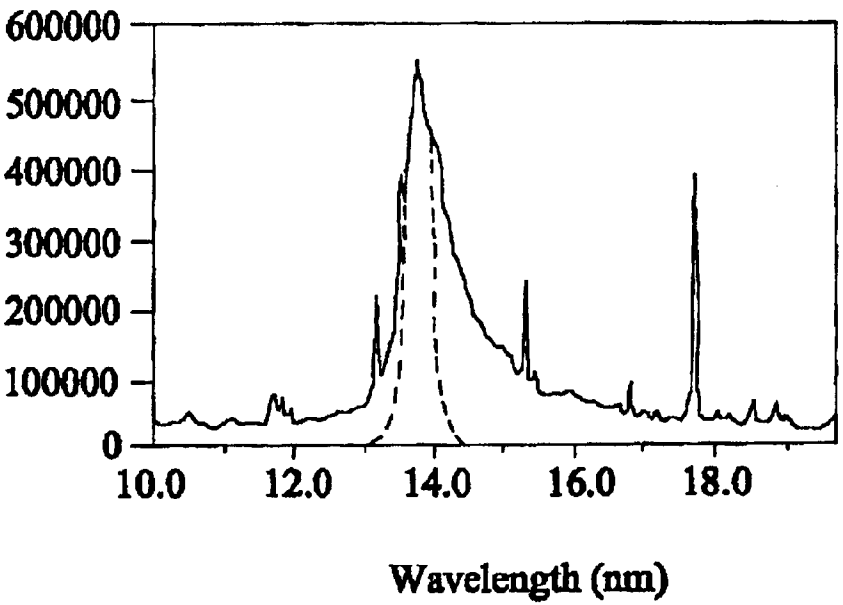
FIG. 5*b* is an EUV spectra of SnCl:H20 droplet target (at approximately 23% solution).
Figure 5A:
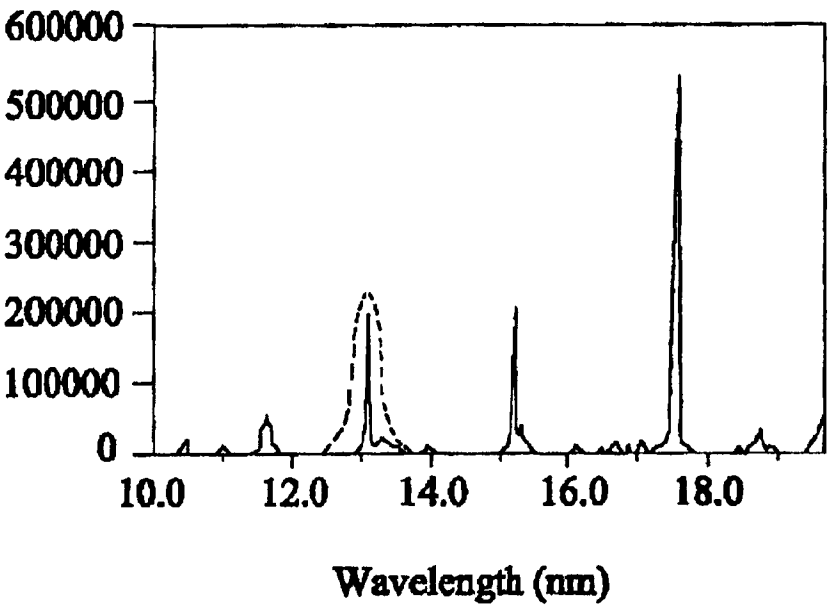
FIG. 5*a* is an EUV spectra of a water droplet target.

FIG. 5*a* is an EUV spectrum of the emission from a pure water droplet target irradiated with a laser. It shows the characteristic lithium(Li) like oxygen emission lines with wavelengths at approximately 11.6 nm, approximately 13 nm, approximately 15 nm and approximately 17.4 nm. Other lines outside the range shown are also emitted.

FIG. 5*b* shows the spectrum of the emission from a water droplet seeded with approximately 25% solution of SnCl (tin chloride) irradiated under similar conditions. In addition to the Oxygen line emission, there is strong band of emission from excited ions of tin shown in the wavelength region of approximately 13 nm to approximately 15 nm. Strong emission in this region is of particular interest for application as a light source for EUV lithography. The spectrums for FIGS. 5*a* and 5*b* would teach the use of the other target solutions referenced in Tables 1A–1F.

As previously described, the novel invention is debris free because of the inherently mass limited nature of the droplet target. The droplet is of a mass such that the laser source completely ionizes (vaporizes) each droplet target, thereby eliminating the chance for the generation of particulate debris to be created. Additionally, the novel invention eliminates damage from target source debris, without having to use protective components such as but not limited to shields such as mylar or debris catchers, or the like.

Although the embodiments describe individual tables of metallic type solutions, the invention can be practiced with combinations of these metallic type solutions as needed.

Second Embodiment—Nano Particles

Metallic solutions of nano particles in various liquids can be used as efficient droplet point sources. Using the same layout as described in the first embodiment in reference to FIGS. 2, 3*a* and 3*b*, nano particles in liquids can be used as point sources. The types of nano particles in liquids can generate optical emissions in the X-ray regions, and EUV wavelength regions, and in the XUV wavelength regions.

Various types of nano particles mixed with liquids is listed in Tables 2A and 2B, respectively.

TABLE 2A

| Nano Particles |
|---|
| Aluminum (Al)<br>Bismuth (Bi)<br>Copper (Cu)<br>Zinc (Zn)<br>Tin (Sb)<br>Gold (Au)<br>Silver (Ag)<br>Yttrium (Y) |

The nano particles can be made of almost any solid material, and be formed from a variety of techniques, such as but not limited to smoke techniques, explosive wires, chemical reactions, and the like. The nano particles can be configured as small grains of a few 10's of nanometers in dimensions, and can individually range in size from approximately 5 nm(nanometer) to approximately 100 nm.

TABLE 2B

| Liquids for suspending nano particles |
|---|
| H2O (water)<br>Oils<br>Oleate materials<br>Soapy solutions<br>Alcohols |

The oils that can be used can include but not be limited to fixed oils such as but not limited to fats, fatty acids, linseed oil, tung oil, hemp seed oil, olive oil, nut oils, cotton seed oil, soybean oil, corn oil. The type of oil is generally chosen for its consistency, and for the manner in which it allows the nano particles to be uniformly miscible. Particular types of particles can mix more evenly depending on the particular oils used.

The oleate materials and the soapy solutions can include but not be limited to metallic salts, soaps, and esters of oleic acid, and can include fatty acids, mon-or ply-ethelinoic unsaturated fatty acids that can contain glycerin and other hydrocarbons. Primarily, the particles should be miscible and be able to mix evenly with the oleate materials and soapy solutions.

The alcohol materials can include but not be limited to common type alcohols, such as but not limited to ethyl, methanol, propyl, isopropyl, trimethyl, and the like. Primarily, the particles should miscible and be able to mix evenly with the alcohol materials.

Referring to Tables 2A and 2B, the novel point sources can include mixtures of metallic nano particles such as tin(Sn), copper(Cu), zinc(Zn), gold(Au), aluminum(Al), and/or bismuth(Bi) in various liquids such as at least one of H2O(water), oils, alcohols, oleates, soapy solutions, and the like, which are described in detail above.

X-ray, EUV, and XUV spectrums of a nano particle fluid would be a composite of the spectra of the ions from its component metals.

While the preferred embodiments describe various wavelength emissions, the invention encompasses metal type targets that can all emit EUV, XUV and X-rays in broad bands. For example, testing has shown that the wavelength ranges of approximately 01 nm to approximately 100 nm, specifically for example, approximately 11.7 nm, approximately 13 nm, wavelength ranges of approximately 0.5 nm to approximately 1.5 nm, and wavelength ranges of approximately 2.3 nm to approximately 4.5 nm are encompassed by the subject invention targets.

Although preferred types of fluids are described above, the invention can allow for other types of fluids. For example, metals such as tin, and tin type particles, aluminum, and aluminum type particles can be mixed with other fluids, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of generating optical emissions from metallic point sources, comprising the steps of:

forming micron-size droplets having individual droplet diameters of approximately 10 micrometers to approximately 100 micrometers, each containing nano-size particles, each nano-size particle ranging in size from approximately 5 nm to approximately 100 nm;

passing the droplets into individual target sources;

irradiating the individual target sources with a laser beam having substantially identical diameter to each of the individual droplets; and producing optical emissions from the irradiated target sources, wherein the steps of forming, passing, irradiating and producing occur at room temperature.

2. The method of claim 1, wherein the droplets include:

nano particles of metals in a liquid.

3. The method of claim 2, wherein the liquid is selected from at least one of:

H2O, oil, oleates, soapy solutions, and alcohol.

4. The method of claim 2, wherein the droplets include:

Tin(Sn) nano-particles in the liquid.

5. The method of claim 2, wherein the droplets include:

Copper(Cu) nano-particles in the liquid.

6. The method of claim 2, wherein the droplets include:

Zinc(Zn) nano-particles in the liquid.

7. The method of claim 2, wherein the droplets include:

Gold(Au) nano-particles in the liquid.

8. The method of claim 2, wherein the droplets include:

Aluminum(Al) nano-particles in the liquid.

9. The method of claim 2, wherein the droplets include:

Bismuth(Bi) nano-particles in the liquid.

10. The method of claim 1, wherein the room temperature includes:

approximately 10 degrees to approximately 30 degrees C.

11. The method of claim 1, wherein the optical emissions include:

EUV emissions.

12. The method of claim 1, wherein the optical emissions include:

XUV emissions.

13. The method of claim 1, wherein the optical emissions include:

X-ray emissions.

14. The method of claim 1, wherein the optical emissions include:

wavelengths of approximately 11.7 nm.

15. The method of claim 1, wherein the optical emissions include:

wavelengths of approximately 13 nm.

16. The method of claim 1, wherein the optical emissions include:

wavelength ranges of approximately 0.1 nm to approximately 100 nm.

17. The method of claim 1, wherein the optical emissions include:

wavelength ranges of approximately 0.5 nm to approximately 1.5 nm.

18. The method of claim 1, wherein the optical emissions include:

wavelength ranges of approximately 2.3 nm to approximately 4.5 nm.

19. An apparatus for generating optical emissions from metallic point sources, comprising:

means for forming micron-size droplets having individual droplet diameters of approximately 10 micrometers to approximately 100 micrometers, each containing nano-size particles, each nano-size particle ranging in size from approximately 5 nm to approximately 100 nm;

means for feeding the droplets into a target path of individual target sources;

means for irradiating the individual target sources with a laser beam; and means for generating optical emissions from the irradiated target sources, wherein the steps of forming, passing, irradiating and producing occur at room temperature.

20. The apparatus of claim 19, wherein the laser beam includes:

a substantially identical diameter to each of the individual droplets.

21. The apparatus of claim 19, wherein the droplets include:

nano particles of metals in a liquid.

22. The apparatus of claim 19, wherein the liquid is selected from at least one of:

$H_2$, oil, oleates, soapy solutions, and alcohol.

23. The apparatus of claim 19, wherein the droplets include:

Tin(Sn) nano-particles in the liquid.

24. The apparatus of claim 19, wherein the droplets include:

Copper(Cu) nano-particles in the liquid.

25. The apparatus of claim 19, wherein the droplets include:

Zinc(Zn) nano-particles in the liquid.

26. The apparatus of claim 19, wherein the droplets include:

Gold(Au) nano-particles in the liquid.

27. The apparatus of claim 19, wherein the droplets include:

Aluminum(Al) nano-particles in the liquid.

28. The apparatus of claim 19, wherein the droplets include:

Bismuth(Bi) nano-particles in the liquid.

* * * * *